US010082756B2

(12) United States Patent
Kawakami

(10) Patent No.: US 10,082,756 B2
(45) Date of Patent: Sep. 25, 2018

(54) IMAGE FORMING APPARATUS AND IMAGE FORMING SYSTEM

(71) Applicant: Konica Minolta, Inc., Tokyo (JP)

(72) Inventor: Hajime Kawakami, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/710,518

(22) Filed: Sep. 20, 2017

(65) Prior Publication Data

US 2018/0081311 A1 Mar. 22, 2018

(30) Foreign Application Priority Data

Sep. 21, 2016 (JP) ..... 2016-183791

(51) Int. Cl.
*G03G 15/20* (2006.01)
*G03G 15/00* (2006.01)

(52) U.S. Cl.
CPC ..... *G03G 15/2089* (2013.01); *G03G 15/2053* (2013.01); *G03G 15/5008* (2013.01); *G03G 2215/2025* (2013.01)

(58) Field of Classification Search
CPC ..... G03G 15/5008; G03G 15/2032; G03G 15/2089; G03G 15/2067; G03G 2215/00949; G03G 2215/2045
See application file for complete search history.

(56) References Cited

U.S. PATENT DOCUMENTS 6,308,021 B1 * 10/2001 Isogai ..... G03G 15/2064 399/67
9,720,357 B2 * 8/2017 Ujiie ..... G03G 15/2025
9,817,345 B2 * 11/2017 Yamano ..... G03G 15/2039
2010/0074643 A1 * 3/2010 Moriguchi ..... G03G 15/2032 399/69
2012/0027477 A1 * 2/2012 Nakayama ..... G03G 15/2064 399/328
2012/0093547 A1 * 4/2012 Baba ..... G03G 15/2032 399/329
2012/0099882 A1 * 4/2012 Tanaka ..... G03G 15/205 399/69
2012/0189339 A1 * 7/2012 Ono ..... G03G 15/2053 399/69
2014/0308050 A1 * 10/2014 Fukamachi ..... G03G 15/2039 399/69

(Continued)

FOREIGN PATENT DOCUMENTS

JP 2008299288 A * 12/2008
JP 2009-151118 7/2009
JP 2010097132 A * 4/2010

*Primary Examiner* — Sevan A Aydin
(74) *Attorney, Agent, or Firm* — Baker Hostetler LLP

(57) ABSTRACT

An image forming apparatus includes: a toner-image fixer that fixes an unfixed toner image on a sheet by conveying the sheet while heating and pressing the sheet at a fixing nip; a pressing force changer that changes a pressing force against the sheet at the fixing nip; and a hardware processor that controls the toner-image fixer and the pressing force changer, in which when a conveying speed of the sheet is changed by controlling the toner-image fixer, the hardware processor causes the conveying speed to change in a state in which the pressing force is decreased by controlling the pressing force changer.

16 Claims, 11 Drawing Sheets

(56) References Cited

U.S. PATENT DOCUMENTS

| | | | | |
|---|---|---|---|---|
| 2014/0348527 | A1* | 11/2014 | Murakami | G03G 15/2028 399/67 |
| 2015/0220029 | A1* | 8/2015 | Samei | G03G 15/2039 399/69 |
| 2015/0220031 | A1* | 8/2015 | Kuribayashi | G03G 15/2089 399/329 |
| 2016/0098003 | A1* | 4/2016 | Uchitani | G03G 15/205 399/331 |
| 2016/0116871 | A1* | 4/2016 | Kikuchi | G03G 15/2053 399/329 |
| 2016/0124358 | A1* | 5/2016 | Yamaguchi | G03G 15/2032 399/68 |

* cited by examiner

IMPLEMENTATION CONDITIONS

| | STATE | CHANGE OF CONVEYING SPEED | CONVEYING SPEED |
|---|---|---|---|
| FIRST CYCLE | IDLING | – | 0 |
| | ↓ | START OF DRIVING | 0→V |
| | PRINTING | – | V |
| | ↓ | END OF DRIVING | V→0 |
| | IDLING | – | 0 |
| SECOND CYCLE | IDLING | – | 0 |
| | ↓ | START OF DRIVING | 0→V |
| | PRINTING | – | V |
| | ↓ | END OF DRIVING | V→0 |
| | IDLING | – | 0 |
| | | | |
| | | | |
| | | | |
| | | | |
| | | | |

FIG. 7

| | | TIMING OF CHANGING CONVEYING SPEED | |
|---|---|---|---|
| EX. 1 CHANGE OF CONVEYING SPEED AT EXTRA-SMALL PRESSING FORCE | CONVEYING SPEED: V→0 (END OF DRIVING) PRESSING FORCE: (LARGE→EXTRA-SAMLL→SMALL) | TIMING OF CHANGING PRESSING FORCE (LARGE→EXTRA-SMALL) 570 mm/s (LARGE) | TIMING OF CHANGING PRESSING FORCE (EXTRA-SMALL→SMALL) 0 mm/s (SMALL) |
| | CONVEYING SPEED: 0→V (START OF DRIVING) PRESSING FORCE: (SMALL→EXTRA-SAMLL→LARGE) | TIMING OF CHANGING PRESSING FORCE (SMALL→EXTRA-SMALL) 0 mm/s (SMALL) | TIMING OF CHANGING PRESSING FORCE(EXTRA-SMALL→LARGE) 570 mm/s (LARGE) |
| COMP. EX. 1-1 SIMULTANEOUS CHANGE OF PRESSING FORCE AND CONVEYING SPEED | CONVEYING SPEED: V→0 (END OF DRIVING) PRESSING FORCE: (LARGE→SMALL) | 570 mm/s (LARGE) | TIMING OF CHANGING PRESSING FORCE (LARGE→SMALL) 0 mm/s (SMALL) |
| | CONVEYING SPEED: 0→V (START OF DRIVING) PRESSING FORCE: (SMALL→LARGE) | 0 mm/s (SMALL) | TIMING OF CHANGING PRESSING FORCE (SMALL→LARGE) 570 mm/s (LARGE) |
| COMP. EX. 1-2 CHANGE OF CONVEYING SPEED AFTER CHANGING PRESSING FORCE | CONVEYING SPEED: V→0 (END OF DRIVING) PRESSING FORCE: (LARGE→SMALL) | TIMING OF CHANGING PRESSING FORCE (LARGE→SMALL) 570 mm/s (LARGE) | 0 mm/s (SMALL) |
| | CONVEYING SPEED: 0→V (START OF DRIVING) PRESSING FORCE: (SMALL→LARGE) | TIMING OF CHANGING PRESSING FORCE (SMALL→LARGE) 0 mm/s (SMALL) | 570 mm/s (LARGE) |
| COMP. EX. 1-3 CHANGE OF PRESSING FORCE AFTER CHANGING CONVEYING SPEED | CONVEYING SPEED: V→0 (END OF DRIVING) PRESSING FORCE: (LARGE→SMALL) | 570 mm/s (LARGE) | TIMING OF CHANGING PRESSING FORCE (LARGE→SMALL) 0 mm/s (SMALL) |
| | CONVEYING SPEED: 0→V (START OF DRIVING) PRESSING FORCE: (SMALL→LARGE) | 0 mm/s (SMALL) | TIMING OF CHANGING PRESSING FORCE (SMALL→LARGE) 570 mm/s (LARGE) |

FIG. 8

| | CONDITION | SHEET TYPE | BASIS WEIGHT | CONVEYING SPEED | ROTATION SPEED | PRESSURE SETTING | SPEED | PRESSURE |
|---|---|---|---|---|---|---|---|---|
| FIRST CYCLE | 1 | STANDARD PAPER | 64g/m² | 125PPM | 570mm/s | LARGE | | |
| | ↓ | | | | | | DECREASE | LARGE→SMALL |
| | 2 | HIGH-QUALITY PAPER | 64g/m² | 70PPM | 330mm/s | SMALL | | |
| | ↓ | | | | | | INCREASE | SMALL→LARGE |
| | 3 | STANDARD PAPER | 64g/m² | 125PPM | 570mm/s | LARGE | | |
| | ↓ | | | | | | SAME | LARGE→SMALL |
| | 4 | STANDARD PAPER | 64g/m² | 125PPM | 570mm/s | SMALL | | |
| | ↓ | | | | | | DECREASE | SMALL→LARGE |
| | 5 | HIGH-QUALITY PAPER | 64g/m² | 70PPM | 330mm/s | LARGE | | |
| | ↓ | | | | | | INCREASE | LARGE→SMALL |
| | 6 | STANDARD PAPER | 64g/m² | 125PPM | 570mm/s | SMALL | | |
| | ↓ | | | | | | SAME | SMALL→LARGE |
| | 1 | STANDARD PAPER | 64g/m² | 125PPM | 570mm/s | LARGE | | |
| | ↓ | | | | | | | |
| | 2 | | | | | | | |
| | ↓ | | | | | | | |
| | 3 | | | | | | | |
| | ↓ | | | | | | | |
| | 4 | | | | | | | |
| | ↓ | | | | | | | |
| | 5 | | | | | | | |
| | ↓ | | | | | | | |
| | 6 | | | | | | | |
| | ↓ | | | | | | | |

FIG. 10

IMAGE FORMING APPARATUS AND IMAGE FORMING SYSTEM

CROSS REFERENCE TO RELATED APPLICATIONS

Japanese Patent Application No. 2016-183791, filed on Sep. 21, 2016, including description, claims, drawings, and abstract the entire disclosure is incorporated herein by reference in its entirety.

BACKGROUND

Technological Field

The present invention relates to an image forming apparatus and an image forming system.

Description of Related Art

An image forming apparatus for forming images through an electrophotographic process typically charges a surface of an image bearing member (photoconductor drum, for example) at a predetermined potential and exposes, corresponding to an image, the image bearing member to form an electrostatic latent image. The latent image on the surface of the photoconductor drum is then visualized as a toner image through developing using a developer (toner) by a developing means. An image is formed on a recording sheet (printing output) by transferring the obtained toner image to the recording sheet (which has been conveyed to the photoconductor drum), conveying the recording sheet bearing the toner image to a fixing unit, and heat-fixing the unfixed toner image on the recording sheet by a fixing nip.

A technique for enhancing separation performance of a sheet during the fixing operation is known (Japanese Patent Application Laid-Open No. 2009-151118 (hereinafter, "Patent Literature (PTL)"), for example). PTL discloses a technique in which a fixing unit includes: a belt for heating a toner on a sheet; a rotary member for forming a heating nip between the belt and the rotary member and allowing the belt to undergo driven rotation; a heater for heating the belt; and changing means for changing a pressing force between the belt and the rotary member, in which the rotation of the belt is started by the rotary member in a state in which a pressing force between the belt and the rotary member is set to be small, and then the pressing force between the belt and the rotary member is switched to large when a temperature of the heater exceeds a predetermined temperature after a predetermined period of time has passed since the start of the rotation, and the belt is rotated at the switched force.

As a productivity-focused printing output method, included is sheet feeding in a combined job in which jobs are combined (coupled) into one job, or sheet feeding (mixed sheet feeding) in which various sheet conditions (sheet size, sheet type, sheet thickness, for example) coexist. In the printing output method, continuous printing through constant operation can be performed even at the timing of switching sheet conditions without entering a temporary standby state (idling state).

In the fixing process of the printing output method, printing conditions, such as a temperature, a fixing pressure, and a conveying speed, are set for every sheet condition so as to ensure stable fixability and sheet conveying properties, for example.

In a case in which a conveying speed and a fixing pressure, for example, are switched simultaneously during the mixed sheet feeding, however, there is a problem in which a fixing member becomes more susceptible to load depending on the timing of switching, and thus there is a risk of lowering durability of the fixing member.

The technique disclosed in PTL does not aim to prevent lowering in durability of a fixing member when a conveying speed and a fixing pressure are switched during image formation, and consequently cannot solve the above problems.

SUMMARY

An object of the present invention is to provide an image forming apparatus and an image forming system that can prevent lowering in durability of a fixing member.

To achieve at least one of the abovementioned objects, an image forming apparatus reflecting one aspect of the present invention includes: a toner-image fixer that fixes an unfixed toner image on a sheet by conveying the sheet while heating and pressing the sheet at a fixing nip; a pressing force changer that changes a pressing force against the sheet at the fixing nip; and a hardware processor that controls the toner-image fixer and the pressing force changer, in which when a conveying speed of the sheet is changed by controlling the toner-image fixer, the hardware processor causes the conveying speed to change in a state in which the pressing force is decreased by controlling the pressing force changer.

To achieve at least one of the abovementioned objects, an image forming system reflecting one aspect of the present invention is composed of a plurality of units including the above image forming apparatus.

BRIEF DESCRIPTION OF DRAWINGS

The advantages and features provided by one or more embodiments of the invention will become more fully understood from the detailed description given hereinbelow and the appended drawings which are given by way of illustration only, and thus are not intended as a definition of the limits of the present invention.

FIG. 7 shows implementation conditions of Example 1;

FIG. 8 shows the timing of changing a conveying speed and the like in Example 1;

FIG. 10 shows implementation conditions of Example 2;

DETAILED DESCRIPTION OF EMBODIMENTS

Hereinafter, one or more embodiments of the present invention will be described with reference to the drawings. However, the scope of the invention is not limited to the disclosed embodiments.

Figure 1:
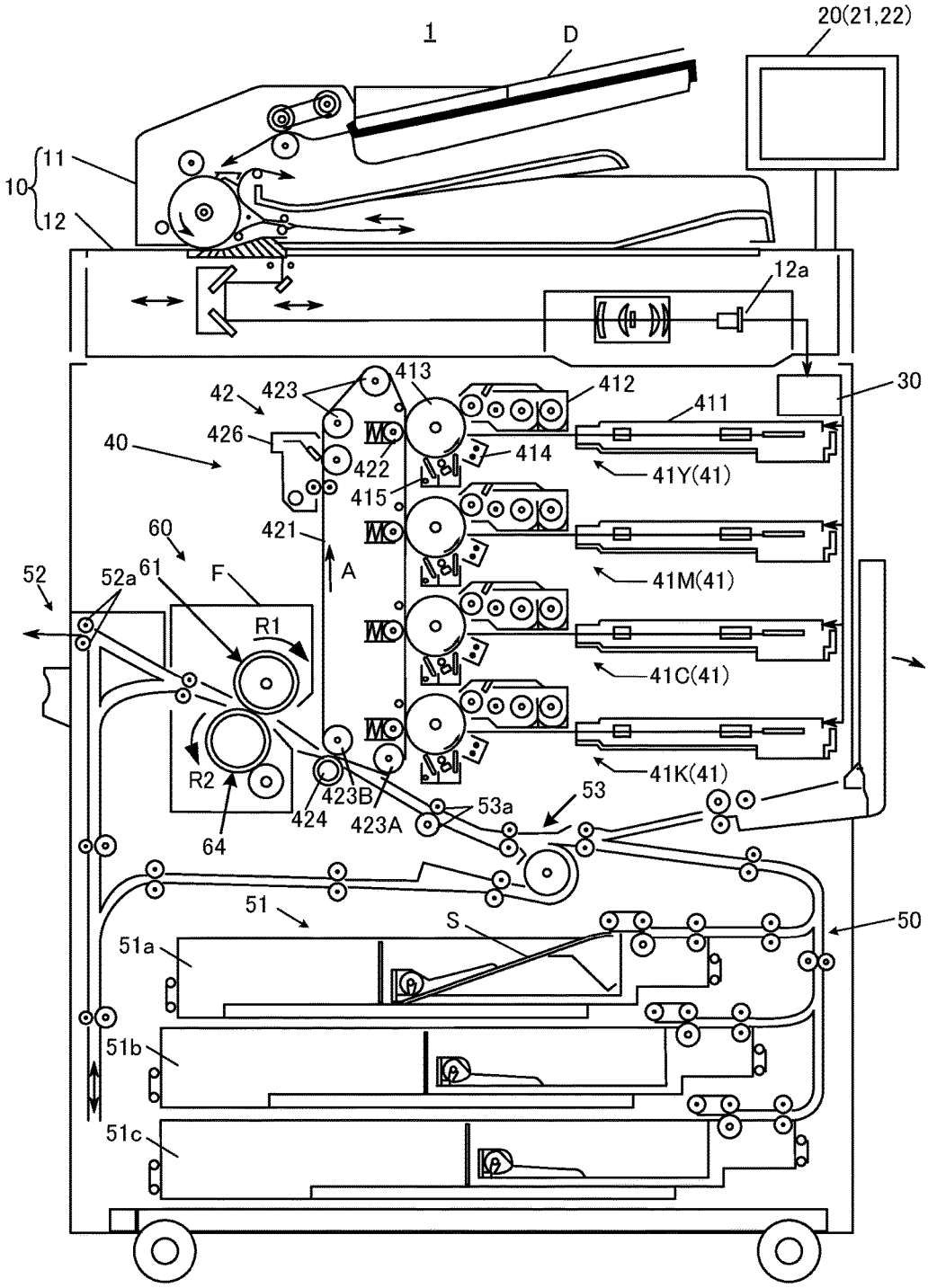
FIG. 1 schematically illustrates an entire configuration of an image forming apparatus according to an embodiment.
Figure 2:
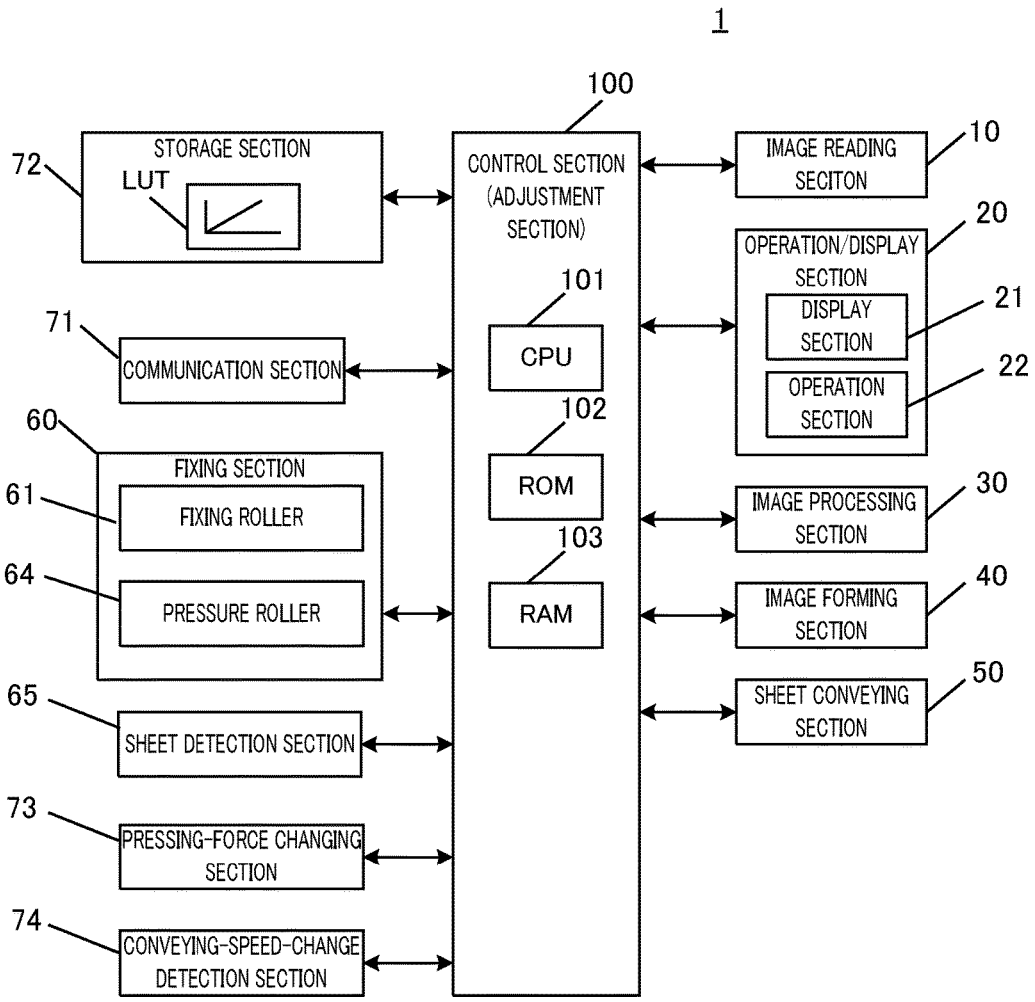
FIG. 2 illustrates a main part of a control system of the image forming apparatus.

FIG. 1 schematically illustrates an entire configuration of image forming apparatus 1 according to an embodiment of the present invention. FIG. 2 illustrates a main part of a control system of image forming apparatus 1 according to the embodiment. Image forming apparatus 1 illustrated in FIGS. 1 and 2 is an intermediate transfer-type color image forming apparatus utilizing electrophotographic process technology. Image forming apparatus 1 transfers color toner images of yellow (Y), magenta (M), cyan (C), and black (K) formed on photoconductor drums 413 to intermediate transfer belt 421 (primary transfer) to superimpose the four color toner images on intermediate transfer belt 421, and then transfers the superimposed images to sheet S to form an image (secondary transfer).

Image forming apparatus 1 employs a tandem mode in which photoconductor drums 413 corresponding to YMCK four colors are arranged in series along the running direction of intermediate transfer belt 421, and each color toner image is successively transferred to intermediate transfer belt 421 in a single procedure.

As illustrated in FIG. 2, image forming apparatus 1 includes image reading section 10, operation/display section 20, image processing section 30, image forming section 40, sheet conveying section 50, image forming section 60, and control section 100.

Control section 100 includes central processing unit (CPU) 101, read-only memory (ROM) 102, and random-access memory (RAM) 103, for example. CPU 101 reads a program corresponding to processing details from ROM 102, loads the program into RAM 103, and performs, cooperatively with the loaded program, centralized control of the operation in respective blocks of image forming apparatus 1. During this step, various data stored in storage section 72 are referred to. Storage section 72 is composed of, for example, a nonvolatile semiconductor memory (so-called flash memory) and/or a hard disk drive.

Control section 100 transmits and receives various data to and from an external apparatus (personal computer, for example) connected to a communication network, such as a local area network (LAN) or a wide area network (WAN), via communication section 71. Control section 100, for example, receives image data transmitted from an external apparatus, and causes an image to form on sheet S based on the image data (input image data). Communication section 71 is composed of, for example, a network interface card, such as a LAN adapter.

Image reading section 10 includes auto document feeder (ADF) 11 and document image scanner 12, for example.

Auto document feeder 11 conveys, with a conveying mechanism, document D placed on a document tray and sends it to document image scanner 12. Auto document feeder 11 can continuously read images on many documents D placed on a document tray at once.

Document image scanner 12 optically scans documents conveyed from auto document feeder 11 onto a contact glass or documents placed on a contract glass, and images reflected light from the documents on a light receiving surface of charge coupled device (CCD) sensor 12*a* to read document images. Image reading section 10 generates input image data based on results read by document image scanner 12. The input image data undergoes predetermined image processing in image processing section 30.

Operation/display section 20 is composed of, for example, a touch panel-type liquid crystal display (LCD), and functions as both display section 21 and operation section 22. Display section 21 displays, for example, various operation screens, the state of images, operation conditions of each function in accordance with display control signals input from control section 100. Operation section 22 equipped with various operation keys, such as a numeric keypad and a start key, receives various input operation by a user and outputs operation signals to control section 100.

Image processing section 30 includes a circuit and/or the like that performs digital image processing of input image data in accordance with default settings or user settings. For example, image processing section 30 performs tone correction based on tone correction data (tone correction table) under the control of control section 100. Moreover, image processing section 30 performs, for example, various correction processing, such as color correction or shading correction, in addition to tone correction, and/or compression processing of input image data. Image forming section 40 is controlled, based on the thus-processed image data.

Image forming section 40 includes, for example, image forming units 41Y, 41M, 41C, and 41K for forming images of color toners of Y component, M component, C component, and K component, based on input image data, and intermediate transfer unit 42.

Image forming units 41Y, 41M, 41C, and 41K for Y component, M component, C component, and K component have similar configurations. For the purpose of convenience in illustration and description, common components are denoted by the same numerals while the numerals are accompanied by Y, M, C, or K when they are distinguished. In FIG. 1, only components of image forming unit 41Y for Y component are denoted by numerals, and numerals are omitted for components of other image forming units 41M, 41C, and 41K.

Image forming unit 41 includes exposing device 411, developing device 412, photoconductor drum 413, charging device 414, and drum cleaning device 415, for example.

Photoconductor drum 413 is, for example, a negative-charging organic photoconductor (OPC) formed by successively laminating an undercoat layer (UCL), a charge generation layer (CGL), and a charge transport layer (CTL) on a peripheral surface of an aluminum conductive cylinder (aluminum tube) having a drum diameter of 80 mm. The charge generation layer is formed from an organic semiconductor composed of a charge generation material (phthalocyanine pigment, for example) dispersed in a resin binder (polycarbonate, for example), and generates pairs of positive charges and negative charges upon exposure by exposing device 411. The charge transport layer is formed from a hole transport material (electron-donating nitrogen compound) dispersed in a resin binder (polycarbonate, for example), and transports positive charges generated in the charge generation layer to a surface of the charge transport layer.

Control section 100 rotates photoconductor drum 413 at a constant peripheral speed by controlling driving current supplied to a driving motor (not shown) for rotating photoconductor drum 413.

Charging device 414 evenly and negatively charges a surface of photoconductor drum 413. Exposing device 411 is configured as a semiconductor laser, for example, and irradiates photoconductor drum 413 with laser beams corresponding to images of respective color components. Thus, positive charges are generated in the charge generation layer of photoconductor drum 413, and transported to the surface of the charge transport layer, thereby neutralizing surface charges (negative charges) of photoconductor drum 413. As a result, electrostatic latent images of respective color components are formed on the surface of photoconductor drum 413 due to potential differences from the surroundings.

Developing device 412 is, for example, a developing device of a two-component developing system, and forms a toner image by attaching a toner of each color component to the surface of photoconductor drum 413 to visualize an electrophotographic latent image.

Drum cleaning device 415 includes a drum cleaning blade or the like to be slid on the surface of photoconductor drum 413, and removes transfer residual toner remaining on the surface of photoconductor drum 413 after primary transfer.

Intermediate transfer unit 42 includes intermediate transfer belt 421, primary transfer roller 422, a plurality of support rollers 423, secondary transfer roller 424, and belt cleaning device 426, for example.

Intermediate transfer belt 421 is composed of an endless belt, and looped around a plurality of support rollers under tension. At least one of a plurality of support rollers 423 is a driving roller, and the rest are driven rollers. For example, roller 423A disposed on the downstream side of primary transfer roller 422 for K component in the running direction of the belt is preferably a driving roller. This facilitates the maintenance of a constant running speed of the belt in a primary transfer section. Intermediate transfer belt 421 runs in arrow A direction at a constant speed by the rotation of driving roller 423A.

Primary transfer roller 422 is disposed facing photoconductor drum 413 of each color component on the side of an inner peripheral surface of intermediate transfer belt 421. A primary transfer nip, for transferring a toner image to intermediate transfer belt 421 from photoconductor drum 413, is formed by firmly pressing primary transfer roller 422 against photoconductor drum 413 via intermediate transfer belt 421.

Secondary transfer roller 424 is disposed facing backup roller 423B disposed on the downstream side of driving roller 423A in the running direction of the belt on the side of an outer peripheral surface of intermediate transfer belt 421. A secondary nip, for transferring a toner image to sheet S from intermediate transfer belt 421, is formed by firmly pressing backup roller 423B against secondary transfer roller 424 via intermediate transfer belt 421.

When intermediate transfer belt 421 passes through the primary transfer nip, toner images on photoconductor drums 413 are successively superimposed and transferred (primary transfer). Specifically, primary transfer bias is applied to primary transfer roller 422 to provide charges with polarity opposite to a toner to a rear surface side (contact side with primary transfer roller 422) of intermediate transfer belt 421, thereby electrostatically transferring a toner image to intermediate transfer belt 421.

After that, when sheet S passes through the secondary transfer nip, toner images on intermediate transfer belt 421 are transferred to sheet S (secondary transfer). Specifically, secondary transfer bias is applied to secondary transfer roller 424 to provide charges with polarity opposite to a toner to a rear surface side (contact side with secondary transfer roller 424) of sheet S, thereby electrostatically transferring a toner image to sheet S. Sheet S bearing a transferred toner image is then conveyed to fixing section 60.

Belt cleaning section 426 includes a belt cleaning blade or the like to be slid on a surface of intermediate transfer belt 421, and removes transfer residual toner remaining on the surface of intermediate transfer belt 421 after secondary transfer. In place of secondary transfer roller 424, a configuration in which a secondary transfer belt looped around a plurality of support rollers including a secondary transfer roller under tension (so-called belt-type secondary transfer unit) may be employed.

Fixing section 60 includes fixing roller 61 disposed on the side of a fixing surface (toner image-formed surface) of sheet S, pressure roller 64 disposed on the side of a rear surface (surface opposite to fixing surface) of a sheet, and cleaning section 66 (see FIG. 3), for example. A fixing nip, for pinching and conveying sheet S, is formed by pressing pressure roller 64 against fixing roller 61.

Fixing section 60 heats and presses conveyed sheet S in which a toner image has been transferred (secondary transfer), thereby fixing the toner image on sheet S. Fixing section 60 is disposed, as a unit, inside fixing device F.

Sheet conveying section 50 includes sheet feeding section 51, sheet ejection section 52, and conveying path section 53, for example. Three sheet feed tray units 51*a* to 51*c*, which constitute sheet feeding section 51, store sheets S classified based on basis weight, size, and/or the like (standard paper, special paper) in accordance with predetermined types. Conveying path section 53 includes a plurality of conveying roller pairs, such as registration roller pair 53*a*.

Sheets S stored in sheet feed tray units 51*a* to 51*c* are each sent out from the uppermost portion one by one and conveyed to image forming section 40 through conveying path section 53. During this step, a registration roller section, where registration roller pair 53*a* is arranged, corrects the tilt of sheets S and adjusts the timing of conveyance. Toner images on intermediate transfer belt 421 are then transferred collectively to one-side surface of sheet S in image forming section 40 (secondary transfer), and a fixing step is performed in fixing section 60. Sheet S bearing a formed image is ejected outside the apparatus by sheet ejection section 52 equipped with sheet ejection rollers 52*a*.

Figure 3:
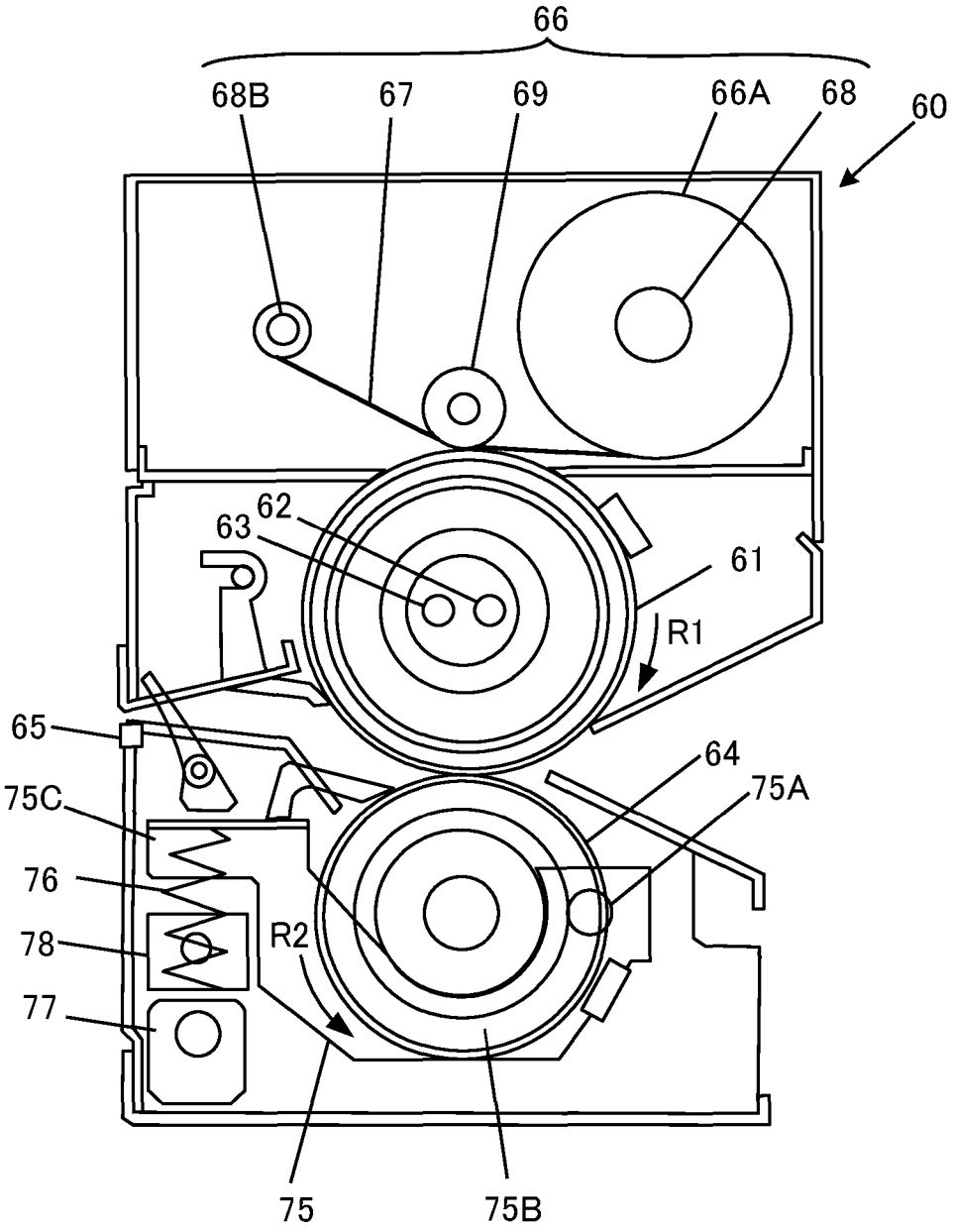
FIG. 3 schematically illustrates a configuration of a fixing section of the image forming apparatus.

With reference to FIGS. 2 and 3, a configuration of fixing section 60 will be described hereinafter. FIG. 3 schematically illustrates a configuration of fixing section 60. Fixing section 60 and control section 100 function as a fixing device. Fixing section 60 and control section 100 may be configured as a unit and installed in image forming apparatus 1, or may be separately installed in image forming apparatus 1 so as to function as a fixing device.

Fixing roller 61 includes halogen heaters 62 and 63 built in the center, a cylindrically formed core of aluminum, iron, copper, or an alloy thereof, a heat-resistant elastomer that is formed from a silicone rubber, a fluororubber, and/or the like and positioned on the outer surface of the core, and a release layer that is formed from a fluororesin, such as a PFA (perfluoroalkoxy alkane) or PTFE (polytetrafluoroethylene), and covers the heat-resistant elastomer.

Pressure roller 64 includes a stainless steel core, a rubber roller composed of a silicone rubber foam positioned on the outer peripheral surface of the core, and a release layer that is composed of a PFA tube and covers the outer peripheral surface of the rubber roller.

Pressure roller 64 is firmly pressed against fixing roller 61 by a predetermined pressing force (fixing load) under force exerted from compression spring 76. Accordingly, a fixing nip for pinching and conveying sheet S is formed between fixing roller 61 and pressure roller 64.

Control section 100 controls a driving source (driving motor, not shown) to rotate pressure roller 64 in arrow R2 direction (counterclockwise direction). Driving control (ON/OFF of rotation, peripheral speed, for example) of the driving motor is performed by control section 100. The peripheral speed of pressure roller 64 is set, for example, to two stages of 330 mm/s and 570 mm/s. The peripheral speed of pressure roller 64 corresponds to a conveying speed of sheet S conveyed by fixing section 60.

When pressure roller 64 is driven/rotated in arrow R2 direction, fixing roller 61 is driven in arrow R1 direction (clockwise direction). During fixing of sheet S, the peripheral speed of fixing roller 61 reaches, for example, two-stages of 330 mm/s and 570 mm/s.

As in the foregoing, fixing roller 61 and pressure roller 64 in fixing section 60 fix an unfixed toner image on sheet S by conveying sheet S while heating and pressing sheet S at the fixing nip.

Sheet detection section 65 is provided at an ejection port of fixing section 60 and detects sheet S ejected from fixing section 60. Alternatively, sheet detection section 65 may be provided at sheet ejection section 52 of image forming apparatus 1. For example, when a conveying speed is changed by the end of driving and sheet detection section 65 detects the last one of sheets S in a printing condition before the end of driving, control section 100 controls the fixing section 60 such that the conveying speed is changed.

In cleaning section 66, long cleaning sheet 67, which is rolled out by take-up shaft 66B from wound roll 66A (in which long cleaning sheet 67 is wound on winding core 68 as a web), is brought into contact with fixing roller 61 by hold-down roller 69 during image formation of a certain number of sheets while being fixed until it proceeds slightly for the next image formation of a certain number of sheets. This wipes away extraneous materials, such as a toner attached on fixing roller 61 during fixing, while uniformly applying silicone oil for enhancing releasability.

Pressing-force changing section 73 includes pressure lever 75, compression spring 76, cam 77, and cam follower 78, for example.

Pressure lever 75 has first end portion 75A rotatably supported by the body of fixing section 60, intermediate portion 75B in contact with pressure roller 64, and second end portion 75C positioned on the side opposite to first end portion 75A via intermediate portion 75B.

Compression spring 76 in a compressed state is disposed between second end portion 75C of pressure lever 75 and cam follower 78.

Cam 77 is provided in the body of fixing section 60 so as to rotate around an axis by a motor (not shown).

Control section 100 controls the motor to rotate cam 77 around the axis, thus causes cam follower 78 to move to a plurality of predetermined positions in the vertical direction of FIG. 3, further causes a distance between cam follower 78 and second end portion 75C of pressure lever 75 to change stepwise, and consequently adjusts restoring force of compression spring 76 (force for bringing pressure lever 75 into contact with pressure roller 64). Accordingly, the control section 100 causes a predetermined pressing force (fixing load) at which pressure roller 64 is firmly pressed against fixing roller 61 to change in three stages of intensities (large pressing force, small pressing force, and extra-small pressing force, for example). Pressing force (fixing load) herein corresponds to "pressing force as a printing condition" of the present invention. The pressing force as a printing condition is not limited to the three stages, and may be two or more stages.

In order to enhance productivity in a case in which jobs are coupled as one combined job and various sheet conditions coexist, the embodiment performs continuous printing without entering a temporary standby state at a timing of switching sheet conditions. Meanwhile, in order to ensure fixability and sheet conveying properties, a conveying speed, a pressing force (fixing load), and/or the like as printing conditions are changed for every sheet condition. As used herein, the phrase "continuous printing" meets at least one condition: there is no state transition (printing state is always maintained without entering a temporary standby state) even during switching sheet conditions (sheet type, basis weight, size, for example) or driving systems (driving systems involving sheet feeding, FS, and/or image formation) are not stopped.

When a conveying speed is changed by the start of driving or the end of driving, and the conveying speed and a pressing force are simultaneously changed, there is a risk of lowering in durability of fixing members, such as pressure roller 64, if the conveying speed is changed at a large pressing force, for example. Accordingly, in order to prevent lowering in durability of fixing members, the conveying speed is preferably changed at a small pressing force as possible.

When changing a conveying speed of sheet S by controlling fixing section 60, control section 100 controls pressing-force changing section 73 such that the conveying speed is changed in a state in which a pressing force is decreased. As used herein, the phrase "a state in which a pressing force is decreased" means a state in which a pressing force is decreased relative to other pressing forces. Specifically, when the intensity of a pressing force is categorized in a plurality of stages (three stages of a large pressing force, a small pressing force, and an extra-small pressing force, for example), "a state in which a pressing force is decreased" refers to a state of a smaller pressing force among a plurality of stages (three stages), i.e., each state of a small pressing force or an extra-small pressing force. Therefore, control section 100 sometimes changes a conveying speed at a small pressing force without changing a pressing force when a state of the small pressing force is reached before changing the pressing force.

When the intensities of the pressing force at the end of driving, the start of driving, and during driving are similarly categorized in three stages, an initial pressing force at the end of driving is a large pressing force, and a final pressing force is a small pressing force. Accordingly, at the end of driving, "a smaller pressing force than pressing forces before and after changing the conveying speed" means an extra-small pressing force. Further, "a smaller one of pressing forces before and after changing the conveying speed" means the small pressing force.

At the start of driving, an initial pressing force is a small pressing force, and a final pressing force is a large pressing force. Accordingly, at the start of driving, "a smaller pressing force than pressing forces before and after changing the conveying speed" means an extra-small pressing force. Further, "a smaller one of pressing forces before and after changing the conveying speed" means the small pressing force.

A pressing force during driving corresponds to a printing condition, and thus is a large pressing force or a small pressing force. Accordingly, during driving, "a smaller pressing force than pressing forces before and after changing the conveying speed" means an extra-small pressing force. Further, "a smaller one of pressing forces before and after changing the conveying speed" means the small pressing force.

Specifically, when a conveying speed is changed by the end of driving, control section 100 determines whether a pressing force at which a conveying speed is changed is set to a small pressing force of the three stages. If it determines to set to the small pressing force, control section 100 controls pressing-force changing section 73 and fixing section 60 such that the conveying speed is changed at the small pressing force. Meanwhile, it determines not to set to the small pressing force, control section 100 controls pressing-force changing section 73 and fixing section 60 such that the conveying speed is changed after changing the pressing force to an extra-small pressing force of the three stages, and then the pressing force is changed to the small pressing force.

When a conveying speed is changed by the start of driving, control section 100 determines whether a pressing force at which a conveying speed is changed is set to a small pressing force of the three stages. If it determines to set to the small pressing force, control section 100 controls pressing-force changing section 73 and fixing section 60 such that the conveying speed is changed at the small pressing force. Meanwhile, it determines not to set to the small pressing force, control section 100 controls pressing-force changing section 73 and fixing section 60 such that the conveying speed is changed after changing the pressing force to an extra-small pressing force of the three stages, and then the pressing force is changed to a large pressing force.

Conveying-speed-change detection section 74 detects the occurrence of a change of a conveying speed, based on at least one detection target corresponding to a priority mode selected by a user. As used herein, the phrase "detection target" refers to a state of fixing section 60, information on state transition of fixing section 60, job information (including current job information and reserved job information), information on a change of a sheet feed tray, a fixing temperature, and a coverage, for example.

TABLE 1

| Priority | Detection Targets |
|---|---|
| Productivity priority mode | State of fixing members, Information on state transition, Current job information, Reserved job information, Information on change of sheet feed tray |
| Image quality/conveying property priority mode | Fixing temperature, Coverage |
| Durability priority mode | State of fixing members, Information on state transition, Current job information, Reserved job information, Information on change of sheet feed tray, Fixing temperature, Coverage |

Correlations between a priority mode and detection targets will be described with reference to Table 1. Table 1 shows correlations between a priority mode and detection targets.

Control section 100 determines whether there is a need for changing a conveying speed in a state in which a pressing force is decreased, based on a detected result of conveying-speed-change detection section 74. Control section 100 causes a conveying speed to change in the state in which a pressing force is decreased if such changing is determined to be needed, and controls pressing-force changing section 73 and fixing section 60 such that a conveying speed is changed regardless of the pressing force if such changing is determined not to be needed. As used herein, the phrase "regardless of the pressing force" means "without changing the pressing force."

As shown in Table 1, conveying-speed-change detection section 74, in the productivity priority mode, detects the occurrence of a change of a conveying speed, based on at least one detection target of a state of fixing section 60, information on state transition of fixing section 60, job information, and information on a change of a sheet feed tray, for example. In the productivity priority mode, since the control that lowers productivity (pages per minute (PPM) control, for example) is not performed, factors related to PPM control are excluded from the detection target. PPM control is herein a control for giving priority to image quality and/or conveying properties. Control section 100 controls fixing section 60 such that a conveying speed is changed regardless of a pressing force at which a conveying speed is changed if it determines that a change of a pressing force results in lowering in productivity based on a detected result of conveying-speed-change detection section 74. "Lowering in productivity" herein means widening space, or a gap, between adjacent sheets S in the conveying direction of sheets S.

Conveying-speed-change detection section 74, in the image quality/conveying property priority mode, detects the occurrence of a change of a conveying speed, based on at least one of a fixing temperature, a coverage, and the like. In the image quality/conveying property priority mode, factors related to PPM control are preferentially detected as the detection target. Control section 100 controls pressing-force changing section 73 such that a pressing force at which a conveying speed is changed is set to a small pressing force of a plurality of stages if changing of a conveying speed is determined to be needed.

Further, conveying-speed-change detection section 74, in the durability priority mode, detects the occurrence of a change of a conveying speed, based on at least one of a state of fixing section 60, information on state transition of fixing section 60, job information, information on a change of a sheet feed tray, a fixing temperature, a coverage, and the like. The durability priority mode, in order to detect factors that give priority to lowering of load on fixing members, sets as many factors as possible as the detection target. Control section 100 controls pressing-force changing section 73 such that a pressing force at which a conveying speed is changed is set to a small pressing force of a plurality of stages if changing of a conveying speed is determined to be needed.

Figure 4:
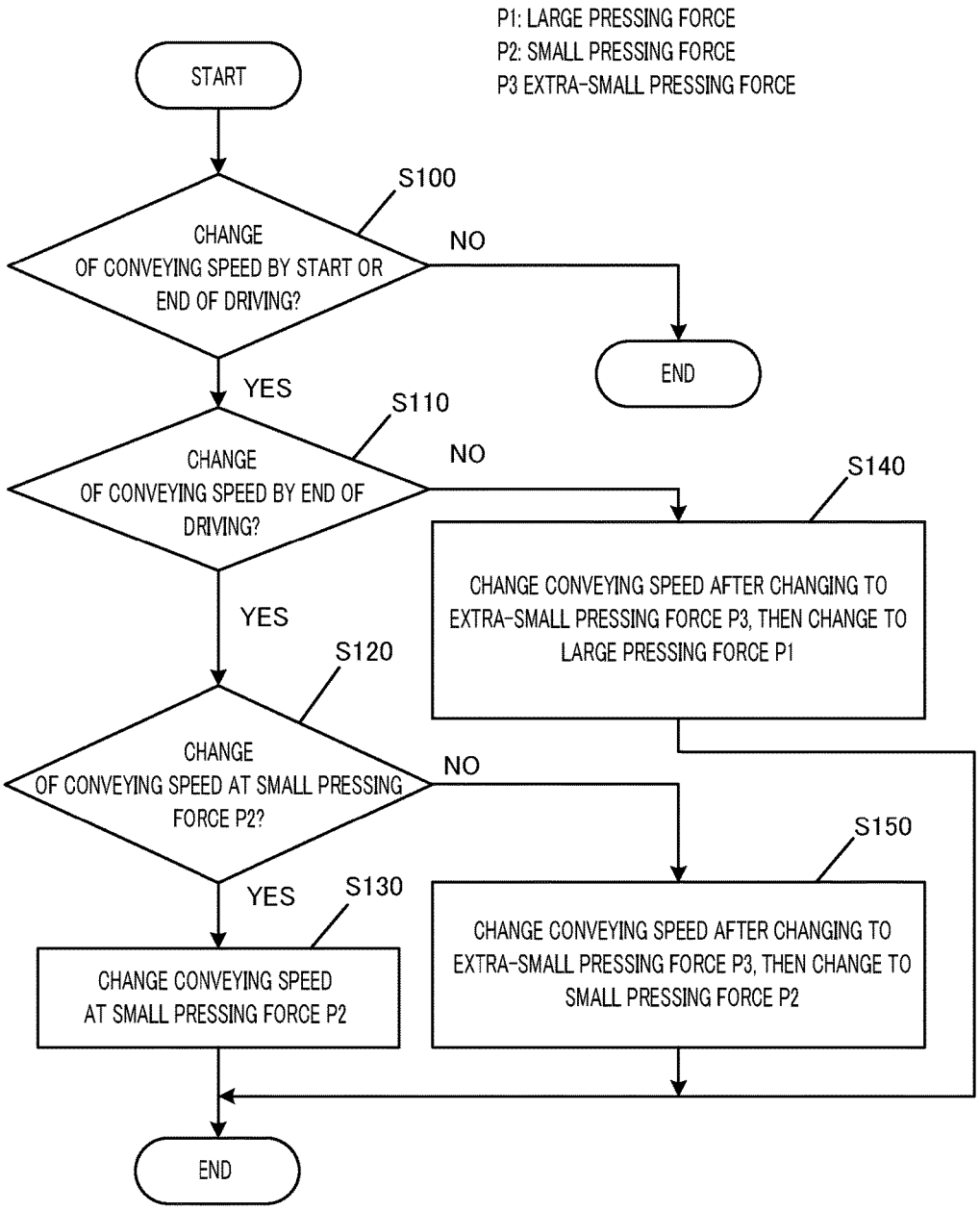
FIG. 4 is a flow chart showing the control operation of the image forming apparatus.

In the following, the operation of image forming apparatus 1 of the embodiment will be described with reference to the flow chart in FIG. 4. The processing shown in FIG. 4 is started, for example, when image forming processing corresponding to a print job is executed. In the processing, a large pressing force is denoted by P1, a small pressing force by P2 (<P1), and an extra-small pressing force by P3 (<P2).

First, in step S100, control section 100 determines whether a conveying speed is changed by the start of driving or the end of driving.

If a conveying speed is changed by the start of driving or the end of driving (step S100: YES), control section 100 determines whether the conveying speed is changed by the end of driving (step S110).

Meanwhile, control section 100 terminates the processing if a conveying speed is not changed by the start of driving or the end of driving (step S100: NO).

In step S110, if the conveying speed is changed by the end of driving (step S110: YES), control section 100 determines whether the conveying speed is changed at small pressing force P2 (step S120).

In step S120, if the conveying speed is changed at small pressing force P2 (step S120: YES), control section 100 controls pressing-force changing section 73 and fixing section 60 such that a pressing force is changed from large pressing force P1 to small pressing force P2, and the conveying speed is changed at small pressing force P2 (step S130). After that, control section 100 terminates the processing.

In step S110, if the conveying speed is not changed by the end of driving (step S110: NO), control section 100 controls pressing-force changing section 73 and fixing section 60 such that the conveying speed is changed after changing a pressing force from large pressing force P1 to extra-small pressing force P3, and then the pressing force is changed to large pressing force P1 (step S140). After that, control section 100 terminates the processing.

In step S120, if the conveying speed is not changed at small pressing force P2 (step S120: NO), control section 100 controls pressing-force changing section 73 and fixing section 60 such that the conveying speed is changed after changing a pressing force from small pressing force P2 to extra-small pressing force P3, and then the pressing force is changed to small pressing force P2 (step S150). After that, control section 100 terminates the processing.

According to image forming apparatus 1 of the embodiment, if a conveying speed is changed by the start of driving or the end of driving, control section 100 controls pressing-force changing section 73 such that a pressing force at which a conveying speed is changed is set to small pressing force P2 or extra-small pressing force P3, and then controls fixing section 60 such that the conveying speed is changed. This can change a conveying speed at a small pressing force, thereby enhancing durability of fixing members, such as pressure roller 64. Also, this can eliminate entering a standby state when a conveying speed is changed, thereby preventing lowering in productivity.

(Modification 1)

Figure 5:
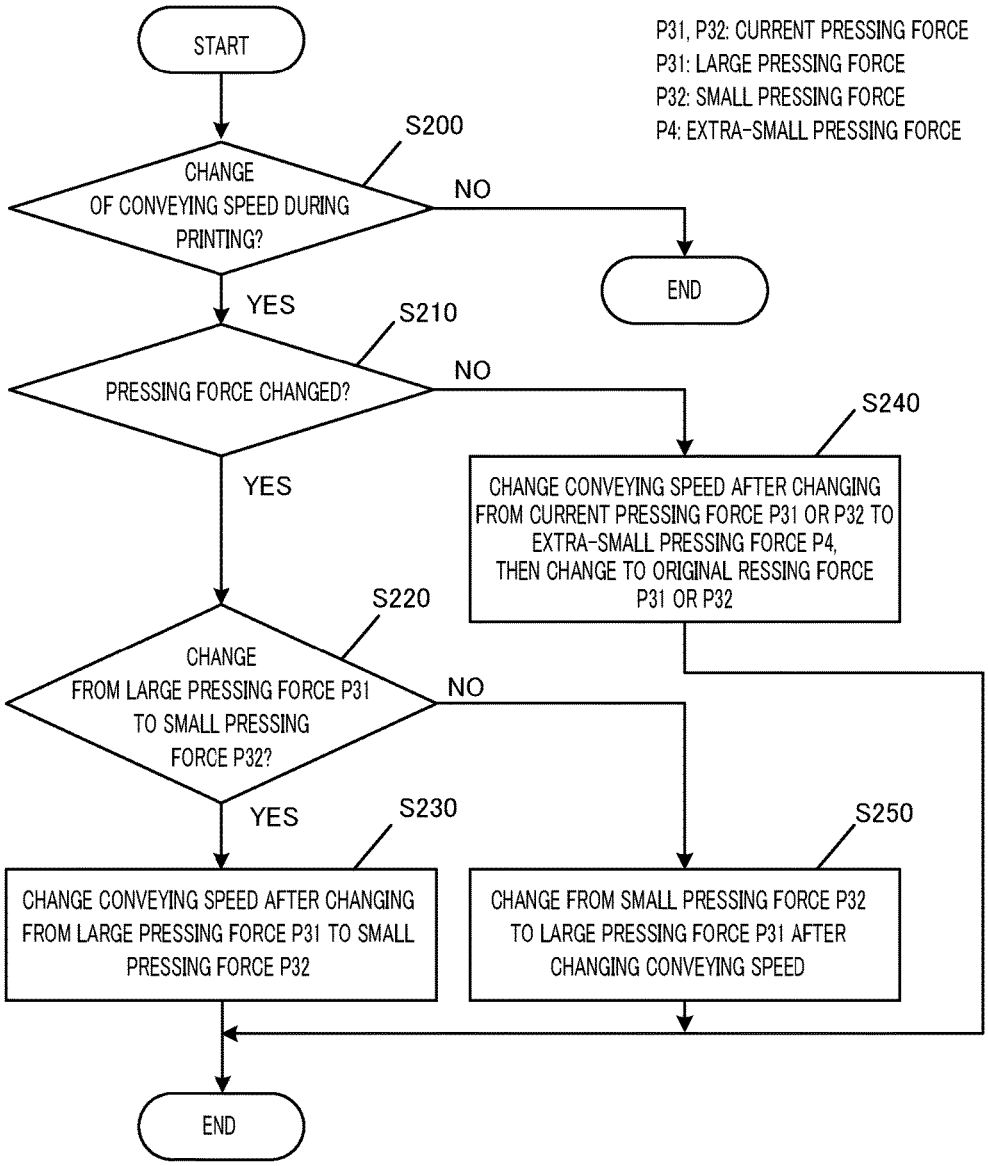
FIG. 5 is a flow chart showing the control operation of the image forming apparatus of Modification 1.

In the following, the operation of image forming apparatus 1 of Modification 1 will be described with reference to the flow chart in FIG. 5.

In the above embodiment, described is the processing for changing a pressing force as a printing condition when a conveying speed is changed by the end of driving or the start of driving. Meanwhile, in Modification 1, described will be the processing for changing a pressing force as a printing condition when a conveying speed is changed during printing (during driving). In the processing, a large pressing force during driving is denoted by P31, a small pressing force by P32 (<P31), and extra-small pressing force by P4 (<P32).

First, in step S200, control section 100 determines whether a conveying speed is changed during printing, based on a detected result of sheet detection section 65 that detects the last one of sheets S in the printing condition before changing the conveying speed.

Control section 100 moves the processing to step S210 if a conveying speed is changed during printing (step S200: YES).

Meanwhile, control section 100 terminates the processing if a conveying speed is not changed during printing (step S200: NO).

In step S210, control section 100 determines whether a pressing force is changed.

If a pressing force is changed (step S210: YES), control section 100 determines whether the pressing force is changed from large pressing force P31 to small pressing force P32 (step S220).

If the pressing force is changed from large pressing force P31 to small pressing force P32 (step S220: YES), control section 100 controls pressing-force changing section 73 and fixing section 60 such that the conveying speed is changed after changing the pressing force from large pressing force P31 to small pressing force P32 (step S230). After that, control section 100 terminates the processing.

In step S220, if a pressing force is changed from small pressing force P32 to large pressing force P31 (step S220: NO), control section 100 controls pressing-force changing section 73 and fixing section 60 such that the pressing force is changed from small pressing force P32 to large pressing force P31 after changing the conveying speed (step S250). After that, control section 100 terminates the processing.

In step S210, if a pressing force is not changed (step S210: NO), control section 100 controls pressing-force changing section 73 and fixing section 60 such that the conveying speed is changed after changing the pressing force from large pressing force P31 (or small pressing force P32) to extra-small pressing force P4, and then the pressing force is changed to the original large pressing force P31 (or small pressing force P32) (step S240). After that, control section 100 terminates the processing.

According to image forming apparatus 1 of Modification 1, if a conveying speed is changed during printing, control section 100 controls pressing-force changing section 73 such that a pressing force at which the conveying speed is changed is set to small pressing force P32 (which is a smaller one of pressing forces P31 and P32) or extra-small pressing force P4, and then controls fixing section 60 such that the conveying speed is changed. This can change a conveying speed at a small pressing force without entering a standby state, thereby enhancing durability of fixing members, such as pressure roller 64, as well as preventing lowering in productivity.

(Modification 2)

Figure 6:
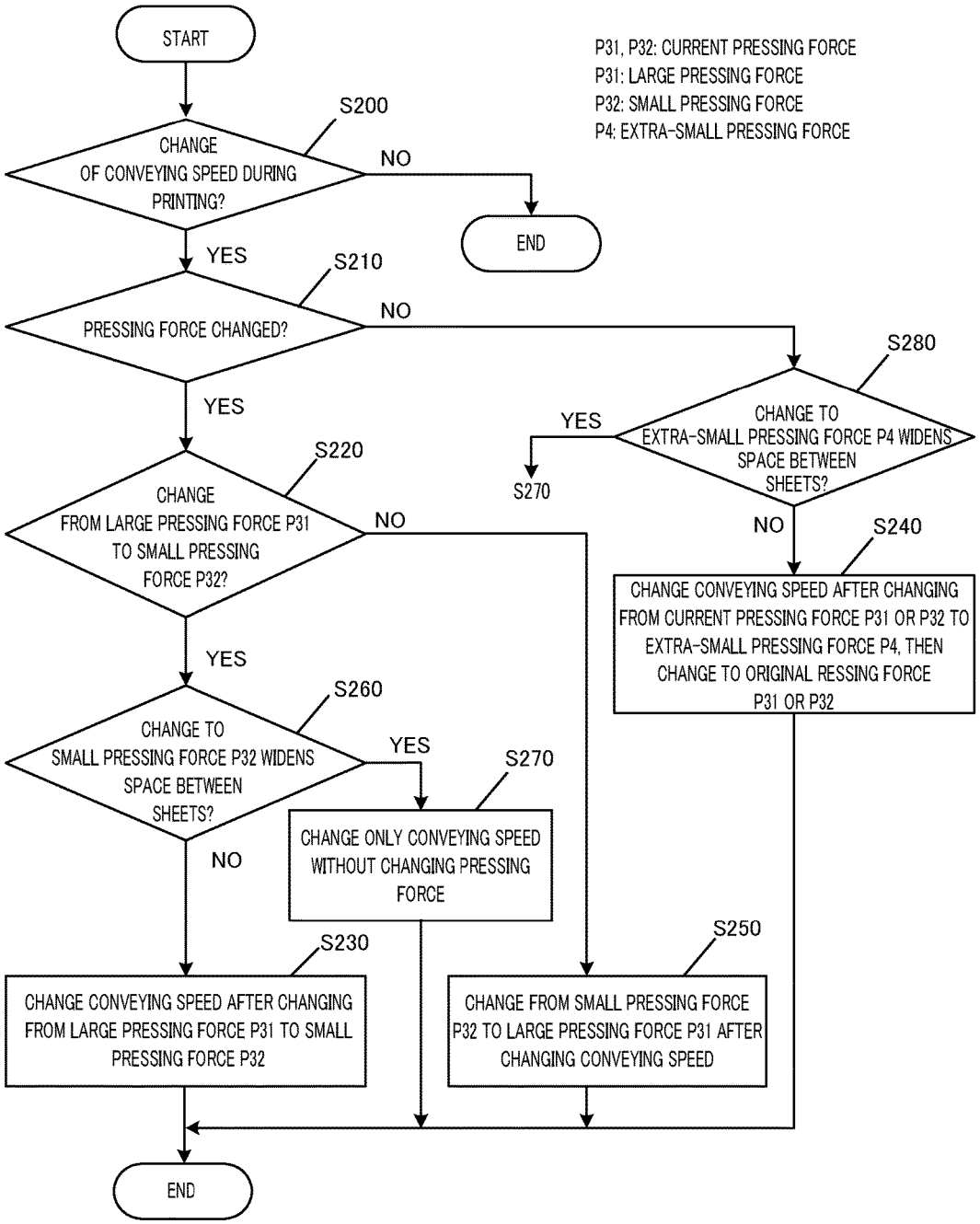
FIG. 6 is a flow chart showing the control operation of the image forming apparatus of Modification 2.

In the following, with reference to the flow chart in FIG. 6, the operation of image forming apparatus 1 of Modification 2 will be described as an example of a case in which a productivity priority mode is selected by a user. The processing of Modification 2 is basically the same processing as Modification 1 except that only a conveying speed is changed without changing a pressing force (fixing load) if productivity lowers.

In the following, the processing different from Modification 1 will be mainly described. The same processing as Modification 1 is represented by the same symbols and the description will be omitted.

In step S220, if a pressing force is changed from large pressing force P31 to small pressing force P32 (step S220: YES), control section 100 determines whether changing to small pressing force P32 results in widening space between sheets (step S260).

In step S260, if space between sheets does not widen (step S260: NO), control section 100 controls pressing-force changing section 73 and fixing section 60 such that the conveying speed is changed after changing the pressing force from large pressing force P31 to small pressing force P32 (step S230).

Meanwhile, in step S260, if space between sheets widens (step S260: YES), control section 100 controls fixing section 60 such that only the conveying speed is changed without changing the pressing force (step S270).

In step S210, if a pressing force is not changed (step S210: NO), control section 100 determines whether changing to extra-small pressing force P4 results in widening space between sheets (step S280).

In step S280, if space between sheets does not widen (step S280: NO), control section 100 controls pressing-force changing section 73 and fixing section 60 such that the conveying speed is changed after changing a pressing force from large pressing force P31 (or small pressing force P32)

to extra-small pressing force P4, and then the pressing force is changed to large pressing force P31 (or small pressing force P32) (step S240).

Meanwhile, in step S280, if space between sheets widens (step S280: YES), control section 100 controls fixing section 60 such that only the conveying speed is changed without changing the pressing force (step S270).

According to image forming apparatus 1 of Modification 2, if changing of the conveying speed during printing results in lowering productivity, such as widening space between sheets, control section 100 controls fixing section 60 such that the conveying speed is changed regardless of the pressing force (without changing the pressing force). This can enhance durability of fixing members and prevent lowering in productivity further.

The present invention is applicable to an image forming system composed of a plurality of units including image forming apparatus 1. A plurality of units include external apparatuses, such as post-processing apparatuses and control apparatuses connected through networks.

In the present invention, if pressing forces are the same (regardless of intensities of the pressing forces) before and after changing the conveying speed by the start of driving, the end of driving, or during driving, control section 100 may control pressing-force changing section 73 and fixing section 60 such that the conveying speed is changed after changing the pressing force to a smaller pressing force than the same pressing force. This can enhance durability of fixing members.

In the above embodiment, control section 100 determines whether fixing section 60 is controlled such that the conveying speed is changed regardless of the pressing force, based on space between sheets. The present invention, however, is not limited to this, and such determination may be made based on other conditions (coverage, for example).

EXAMPLES

Finally, results of the experiments performed by the present inventors to confirm the effectiveness of the embodiments will be described.

Configuration of Image Forming Apparatus of Examples 1 and 2

Image forming apparatus 1 having the configuration of FIGS. 1 and 2 was used as an image forming apparatus in Examples 1 and 2.

[Conditions of Experiment 1]

As shown in FIG. 7, 10,000 cycles of changing a conveying speed by the start of driving and the end of driving were performed as the condition of Experiment 1. In one cycle of printing, 200 sheets were fed, and thus 2 million sheets were fed in total. After the experiment, the durability of pressure rollers was compared/evaluated.

Conditions of Example 1, and Comparative Examples 1-1, 1-2, and 1-3 in Experiment 1

TABLE 2

Conditions of Example and Comparative Examples in Experiment 1

| Condition | Timing of Changing Pressing Force and Conveying Speed |
|---|---|
| Ex. 1 | Changing conveying speed at extra-small pressing force |
| Comp. Ex. 1-1 | Simultaneously Changing pressing force and conveying speed |
| Comp. Ex. 1-2 | Before: changing pressing force/After: changing conveying speed |
| Comp. Ex. 1-3 | Before: changing conveying speed/After: changing pressing force |

As shown in Table 2, a conveying speed was changed at an extra-small pressing force in Example 1. In Comparative Example 1-1, a pressing force and a conveying speed were changed simultaneously. In Comparative Example 1-2, a conveying speed was changed after changing a pressing force. In Comparative Example 1-3, a pressing force was changed after changing a conveying speed.

As shown in FIG. 8, the conveying speed was changed from 570 mm/s to 0 mm/s by the end of driving in Example 1 and the Comparative Examples. Also, the conveying speed was changed from 0 mm/s to 570 mm/s by the start of driving. The initial pressing force at the end of driving was set to a large pressing force, and the final pressing force at the end of driving was set to a small pressing force. Meanwhile, the initial pressing force at the start of driving was set to a small pressing force, and the final pressing force at the start of driving was set to a large pressing force.

In Example 1, when the conveying speed was changed by the end of driving and the start of driving, the pressing force at which the conveying speed was changed was set to an extra-small pressing force.

In Comparative Example 1-1, at the end of driving, the pressing force was changed from a large pressing force to a small pressing force simultaneously while the conveying speed was changed. At the start of driving, the pressing force was changed from a small pressing force to a large pressing force simultaneously while the conveying speed was changed.

In Comparative Example 1-2, at the end of driving, the pressing force was changed from a large pressing force to a small pressing force before the conveying speed was changed. In other words, the conveying speed was changed at the small pressing force. At the start of driving, the pressing force was changed from a small pressing force to a large pressing force before the conveying speed was changed. In other words, the conveying speed was changed at the large pressing force.

In Comparative Example 1-3, at the end of driving, the pressing force was changed from a large pressing force to a small pressing force after the conveying speed was changed. In other words, the conveying speed was changed at the large pressing force. At the start of driving, the pressing force was changed from a small pressing force to a large pressing force after the conveying speed was changed. In other words, the conveying speed was changed at the small pressing force.

[Measurement of Pressure Rollers]

In Example 1 and the Comparative Examples, the hardness of the pressure rollers was measured with an Asker C durometer at the time of feeding no sheet, 500,000 sheets, 1 million sheets, and 2 million sheets.

TABLE 3

| Hardness of Pressure Rollers | | | | |
|---|---|---|---|---|
| | Number of Prints (10,000P) | | | |
| | 0 | 50 | 100 | 200 |
| Ex. 1 | 60 | 57 | 53 | 50 |
| Comp. Ex. 1-1 | 60 | 51 | 43 | 36 |
| Comp. Ex. 1-2 | 60 | 54 | 47 | 42 |
| Comp. Ex. 1-3 | 60 | 54 | 48 | 43 |

Table 3 shows the measured hardness of the pressure rollers.

Figure 9:
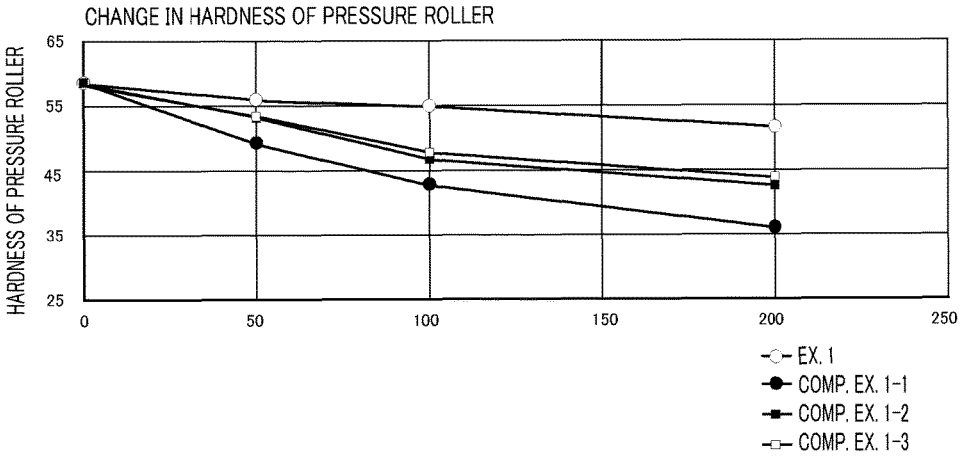
FIG. 9 shows correlations between hardness of pressure rollers and the number of fed sheets in Example 1 and each Comparative Example.

FIG. 9 shows correlations between the number of fed sheets and the hardness of the pressure rollers. In FIG. 9, the horizontal axis represents the number of fed sheets (unit: 10,000 prints), and the vertical axis represents the hardness of the pressure rollers. The changes in the hardness of the pressure rollers were plotted in FIG. 9.

Evaluation of Example 1 and Comparative Examples

TABLE 4

| | Effects on Images | Appearance Ranking |
|---|---|---|
| Ex. 1 | A | A |
| Comp. Ex. 1-1 | C | C |
| Comp. Ex. 1-2 | B | C |
| Comp. Ex. 1-3 | B | C |

As shown in Table 4, the evaluations concerning effects on images are represented as follows.

A: No effects on images

B: Some but substantially no effects on images

C: Adverse effects on images

The evaluations concerning the state of the pressure rollers were ranked based on the appearance, such as a tube-like crease or a crack.

A: No defects in appearance

B: Some changes in appearance

C: Poor state in appearance

Example 1 was evaluated as no effects on images and no defects in appearance. Such evaluation is obtained presumably because the conveying speed was changed at an extra-small pressing force in Example 1, thereby enhancing durability of the pressure roller. In contrast, Comparative Example 1-1 was evaluated as adverse effects on images and a poor state in appearance. Such evaluation is presumably because the conveying speed and the pressing force were changed simultaneously, thereby lowering durability of the pressure roller. Comparative Example 1-2 was evaluated as some but substantially no effects on images and a poor state in appearance. Such evaluation is presumably because the conveying speed was changed by the start of driving at a large pressing force, thereby lowering durability of the pressure roller. Comparative Example 1-3 was evaluated as some but substantially no effects on images and a poor state in appearance. Such evaluation is presumably because the conveying speed was changed by the end of driving at a large pressing force, thereby lowering durability of the pressure roller.

[Conditions of Experiment 2]

As shown in FIG. 10, 7,000 cycles (conditions 1 to 6 as 1 cycle, 50 prints per condition or 300 prints per cycle) were performed as Experiment 2 during driving, and thus 2.1 million sheets were printed in total. After the experiment, the durability of pressure rollers was compared/evaluated.

One cycle was arranged as follows. Standard paper (basis weight 64 g/m$^2$) was conveyed at a conveying speed of 125 prints/min (corresponding to the rotation speed of the pressure roller of 570 mm/s) and a large pressing force (Condition 1). The pressing force was then changed from the large pressing force to a small pressing force, and the conveying speed was changed from a conveying speed of 125 prints/min to 70 prints/min (corresponding to the rotation speed of the pressure roller of 330 mm/s) (from Condition 1 to Condition 2). High-quality paper (basis weight 64 g/m$^2$) was conveyed at a conveying speed of 70 prints/min and the small pressing force (Condition 2). The pressing force was then changed from the small pressing force to the large pressing force and the conveying speed was changed from 70 prints/min to 125 prints/min (from Condition 2 to Condition 3). Standard paper was then conveyed at a conveying speed of 125 prints/min and the large pressing force (Condition 3). The pressing force was then changed from the large pressing force to the small pressing force while the conveying speed was maintained at 125 prints/min (from Condition 3 to Condition 4). After that, standard paper was conveyed at a conveying speed of 125 prints/min and the small pressing force (Condition 4). The pressing force was then changed from the small pressing force to the large pressing force and the conveying speed was changed from 125 prints/min to 70 prints/min (from Condition 4 to Condition 5). High-quality paper was then conveyed at a conveying speed of 70 prints/min and the large pressing force (Condition 5). The pressing force was then changed from the large pressing force to the small pressing force and the conveying speed was changed from 70 prints/min to 125 prints/min (from Condition 5 to Condition 6). Standard paper was then conveyed at a conveying speed of 125 prints/min and the small pressing force (Condition 6).

Conditions of Example 2, and Comparative Examples 2-1, 2-2, and 2-3 in Experiment 2

TABLE 5

| | Timing of Changing Pressure | FIGS. |
|---|---|---|
| Ex. 2 | Before changing conveying speed if pressure is changed from large to small | B |
| | After changing conveying speed if pressure is changed from small to large | F |
| Comp. Ex. 2-1 | Simultaneously with changing conveying speed regardless of change of pressure (large/small) | A, D |
| Comp. Ex. 2-2 | Before changing conveying speed regardless of change of pressure (large/small) | B, E |
| Comp. Ex. 2-3 | After changing conveying speed regardless of change of pressure (large/small) | C, F |

As shown in Table 5, in Example 2, the pressing force was changed before changing the conveying speed if the pressing force was changed from a large pressing force to a small pressing force, whereas the pressing force was changed after changing the conveying speed if the pressing force was changed from a small pressing force to a large pressing force. In Comparative Example 2-1, the pressing force and the conveying speed were changed simultaneously regardless of increase/decrease of the pressing force (regardless of from a large to a small, or from a small to a large). In comparative Example 2-2, the pressing force was changed regardless of increase/decrease of the pressing force before changing the conveying speed. In comparative Example 2-3, the pressing force was changed regardless of increase/decrease of the pressing force after changing the conveying speed.

Figure 11:
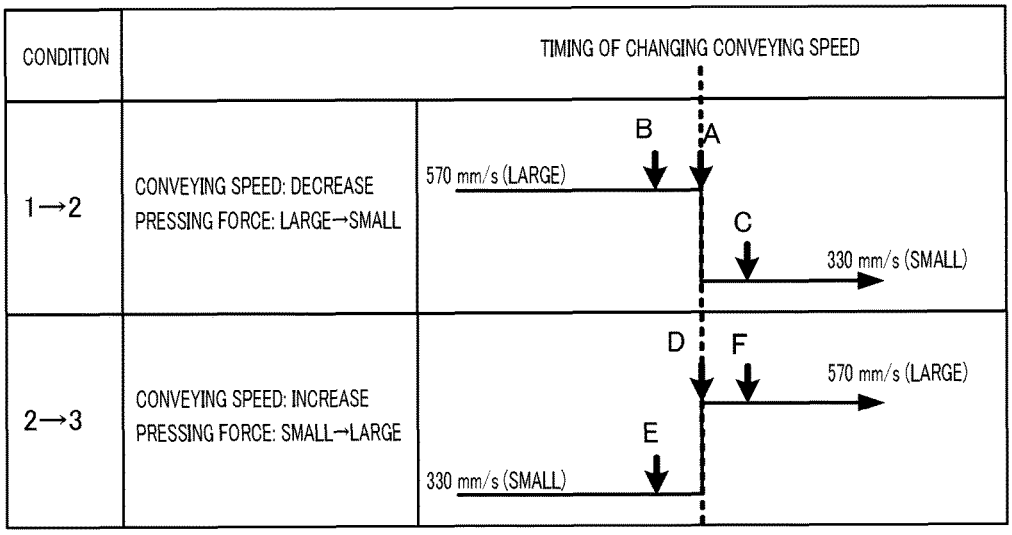
FIG. 11 shows the timing of changing a conveying speed and the like in Example 2.

As shown in FIG. 11, at the timing of changing from Condition 1 to Condition 2, Example 2 and the Comparative Examples each performed a case in which the pressing force and the conveying speed were changed simultaneously (represented by "A" in FIG. 11), a case in which the pressing force was changed before changing the conveying speed (represented by "B" in FIG. 11), or a case in which the pressing force was changed after changing the conveying speed (represented by "C" in FIG. 11).

Further, at the timing of changing from Condition 2 to Condition 3, performed was a case in which the pressing force and the conveying speed were changed simultaneously (represented by "D" in FIG. 11), a case in which the pressing force was changed before changing the conveying speed (represented by "E" in FIG. 11), or a case in which the pressing force was changed after changing the conveying speed (represented by "F" in FIG. 11).

[Measurement of Pressure Rollers]

In Example 2 and the Comparative Examples, the hardness of the pressure rollers was measured with an Asker C durometer at the time of feeding no sheet, 500,000 sheets, 1 million sheets, and 2 million sheets.

TABLE 6

Hardness of Pressure Rollers

| | Number of Prints (10,000P) | | | |
|---|---|---|---|---|
| | 0 | 50 | 100 | 200 |
| Ex. 2 | 60 | 58 | 57 | 55 |
| Comp. Ex. 2-1 | 60 | 53 | 48 | 40 |
| Comp. Ex. 2-2 | 60 | 56 | 52 | 47 |
| Comp. Ex. 2-3 | 60 | 55 | 53 | 48 |

Table 6 shows the measured hardness of the pressure rollers.

Figure 12:
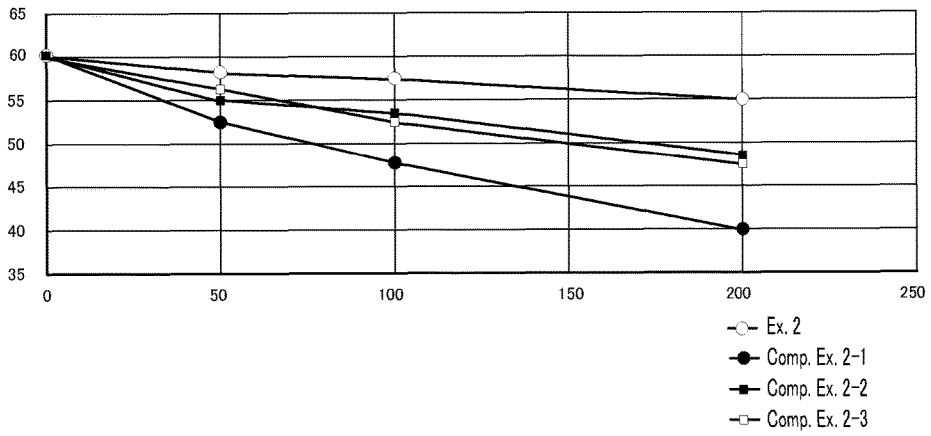
FIG. 12 shows correlations between hardness of pressure rollers and the number of fed sheets in Example 2 and each Comparative Example.

FIG. 12 shows correlations between the number of fed sheets and the hardness of the pressure rollers. In FIG. 12, the horizontal axis represents the number of fed sheets (unit: 10,000 prints), and the vertical axis represents the hardness of the pressure rollers. The changes in the hardness of the pressure rollers were plotted in FIG. 12.

Evaluation of Example 2 and Comparative Examples

TABLE 7

| | Effects on Images | Appearance Ranking |
|---|---|---|
| Ex. 2 | A | A |
| Comp. Ex. 2-1 | C | C |
| Comp. Ex. 2-2 | B | B |
| Comp. Ex. 2-3 | B | B |

As shown in Table 7, the evaluations concerning effects on images are represented as follows.

A; No effects on images

B; Some but substantially no effects on images

C; Adverse effects on images

The evaluations concerning the state of the pressure rollers were ranked based on the appearance, such as a tube-like crease or a crack.

A; No defects in appearance

B; Some changes in appearance

C; Poor state in appearance

Example 2 was evaluated as no effects on images and no defects in appearance. Such evaluation is obtained presumably because the conveying speed was changed during driving at a small pressing force in Example 2, thereby enhancing durability of the pressure roller. In contrast, Comparative Example 2-1 was evaluated as some but substantially no effects on images and a poor state in appearance. Such evaluation is presumably because the conveying speed and the pressing force were changed simultaneously, thereby lowering durability of the pressure roller. Comparative Example 2-2 was evaluated as some but substantially no effects on images and a poor state in appearance. Such evaluation is presumably because the conveying speed was changed at a large pressing force when the printing condition was changed (from Condition 2 to Condition 3), thereby lowering durability of the pressure roller. Comparative Example 2-3 was evaluated as some but substantially no effects on images and a poor state in appearance. Such evaluation is presumably because the conveying speed was changed at a large pressing force when the printing condition was changed (from Condition 1 to Condition 2), thereby lowering durability of the pressure roller.

Although embodiments of the present invention have been described and illustrated in detail, it is clearly understood that the same is by way of illustration and example only and not limitation, the scope of the present invention should be interpreted by terms of the appended claims.

What is claimed is:

1. An image forming apparatus comprising:

a toner-image fixer that fixes an unfixed toner image on a sheet by conveying the sheet while heating and pressing the sheet at a fixing nip;

a pressing force changer that changes a pressing force against the sheet at the fixing nip; and a hardware processor that controls the toner-image fixer and the pressing force changer, wherein when a conveying speed of the sheet is changed by controlling the toner-image fixer, the hardware processor causes the conveying speed to change in a state in which the pressing force is decreased by controlling the pressing force changer.

2. The image forming apparatus according to claim 1, wherein:

the toner-image fixer changes the pressing force, based on a printing condition in which an intensity of the pressing force is categorized in a plurality of stages; and when the conveying speed is changed by a start of driving or an end of driving of the toner-image fixer, the hardware processor causes the conveying speed to change while the state in which the pressing force is decreased is set to a state of a small pressing force among the stages.

3. The image forming apparatus according to claim 1, wherein:

the toner-image fixer changes the pressing force, based on a printing condition in which an intensity of the pressing force is categorized in a plurality of stages; and when the conveying speed is changed during driving of the toner-image fixer, the hardware processor causes the conveying speed to change while the state in which a pressing force is decreased is set to a state of a small pressing force among the stages.

4. The image forming apparatus according to claim 3, wherein during the driving is during continuous printing.

5. The image forming apparatus according to claim 3, wherein during the driving is under pages per minute (PPM) control for enhancing image quality or conveying properties.

6. The image forming apparatus according to claim 2, wherein the small pressing force is a pressing force smaller than pressing forces before and after changing the conveying speed.

7. The image forming apparatus according to claim 2, wherein the small pressing force is a smaller one of pressing forces before and after changing the conveying speed.

8. The image forming apparatus according to claim 1, further comprising a conveying-speed-change detector that detects an occurrence of a change of the conveying speed.

9. The image forming apparatus according to claim 8, wherein the conveying-speed-change detector detects the occurrence of a change of the conveying speed, based on at least one of a state of the toner-image fixer, information on state transition of the toner-image fixer, job information, information on a change of a sheet feed tray, a fixing temperature, and a coverage.

10. The image forming apparatus according to claim 8, wherein the hardware processor determines whether there is a need for changing the conveying speed in the state in which a pressing force is decreased, based on a detected result of the conveying-speed-change detector, and causes the conveying speed to change in the state in which the pressing force is decreased if such changing is determined to be needed, or controls the pressing force changer and the toner-image fixer such that the conveying speed is changed regardless of the pressing force if such changing is determined not to be needed.

11. The image forming apparatus according to claim 10, wherein when productivity lowers, the hardware processor controls the pressing force changer and the toner-image fixer such that the conveying speed is changed regardless of the pressing force.

12. The image forming apparatus according to claim 2, wherein when the conveying speed is changed by the start of the driving or the end of the driving and pressing forces are the same before and after changing the conveying speed, the hardware processor controls the pressing force changer such that the conveying speed is changed at a smaller pressing force than the pressing force before and after the changing, and then the pressing force is changed to the original pressing force.

13. The image forming apparatus according to claim 3, wherein when the conveying speed is changed during the driving and pressing forces are the same before and after changing the conveying speed, the hardware processor controls the pressing force changer such that the conveying speed is changed at a smaller pressing force than the pressing force before and after the changing, and then the pressing force is changed to the original pressing force.

14. The image forming apparatus according to claim 2, further comprising a sheet detector that detects the sheet ejected from the toner-image fixer or an apparatus body, wherein;

when a conveying speed is changed by the end of the driving and the sheet detector detects a last one of the sheet in the printing condition before the end of the driving, the hardware processor controls the toner-image fixer such that the conveying speed is changed.

15. The image forming apparatus according to claim 3, further comprising a sheet detector that detects the sheet ejected from the toner-image fixer or an apparatus body, wherein;

when the conveying speed is changed during the driving and the sheet detector detects a last one of the sheet in the printing condition before changing the conveying speed, the hardware processor controls the toner-image fixer such that the conveying speed is changed.

16. An image forming system comprising a plurality of units including the image forming apparatus according to claim 1.

* * * * *